US010353338B2

(12) United States Patent
Yamana

(10) Patent No.: US 10,353,338 B2
(45) Date of Patent: Jul. 16, 2019

(54) SENSOR UNIT AND IMAGE FORMING APPARATUS

(71) Applicant: CANON KABUSHIKI KAISHA, Tokyo (JP)

(72) Inventor: Kentaro Yamana, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 13 days.

(21) Appl. No.: 15/874,606

(22) Filed: Jan. 18, 2018

(65) Prior Publication Data

US 2018/0210392 A1 Jul. 26, 2018

(30) Foreign Application Priority Data

Jan. 20, 2017 (JP) ..... 2017-008954

(51) Int. Cl.

| | |
|---|---|
| ***G03G 15/00*** | (2006.01) |
| ***G03G 21/00*** | (2006.01) |
| ***G03G 21/16*** | (2006.01) |
| *G03G 15/16* | (2006.01) |

(52) U.S. Cl.

CPC ..... *G03G 21/1676* (2013.01); *G03G 15/5054* (2013.01); *G03G 15/1605* (2013.01)

(58) Field of Classification Search

CPC ..... G03G 15/1605; G03G 15/5054; G03G 21/1676

See application file for complete search history.

(56) References Cited

U.S. PATENT DOCUMENTS

2014/0294420 A1* 10/2014 Lee ..... G03G 21/0005 399/74

FOREIGN PATENT DOCUMENTS

| | | |
|---|---|---|
| JP | 2009-237472 A | 10/2009 |
| JP | 2011-141216 A | 7/2011 |
| JP | 4724288 B2 | 7/2011 |

* cited by examiner

*Primary Examiner* — David M. Gray
*Assistant Examiner* — Michael A Harrison
(74) *Attorney, Agent, or Firm* — Canon U.S.A., Inc. IP Division

(57) ABSTRACT

There is provided a configuration in which a foreign object is less likely to drop onto a detection surface of a sensor when a protection member moves. The protection member is disposed above the sensor movably between a first position and a second position, and has a detection hole formed to expose a detection surface of the sensor at the first position. The protection member covers the detection surface in a part, in which the detection hole is not formed, at the second position. A protruding wall portion is provided at least at an upstream edge of the detection hole, with respect to a direction in which the protection member moves from the second position to the first position, so as to protrude upward from a top surface of the protection member.

20 Claims, 7 Drawing Sheets

SENSOR UNIT AND IMAGE FORMING APPARATUS

BACKGROUND OF THE INVENTION

Field of the Invention

The present disclosure relates to, for example, a sensor unit having a sensor capable of detecting a toner image, and to an image forming apparatus including such a sensor unit, such as a copier, a printer, a facsimile, and a multifunction apparatus having these functions.

Description of the Related Art

For an image forming apparatus, there is known a configuration for primarily transferring a toner image from a photosensitive drum to an intermediate transfer belt, and secondarily transferring the toner image from the intermediate transfer belt to a recording member. There is also known a configuration for forming a toner image for control on an intermediate transfer belt, and performing various kinds of control by detecting the toner image for control with a sensor.

In such a configuration, in a case where a foreign object, such as toner and paper dust, adheres to a detection surface of the sensor, detection accuracy of the sensor may decrease. To address this situation, Japanese Patent No. 4724288 discusses a configuration in which a protection member having a detection hole covers a detection surface of a sensor. In the configuration discussed in Japanese Patent No. 4724288, the protection member is moved to expose the detection surface of the sensor via a detection hole when an openable and closable door provided at an apparatus main body is closed, and to cover the detection surface when the openable and closable door is opened.

In the configuration having such a protection member, foreign objects accumulated on the protection member may drop onto the detection surface of the sensor from the detection hole, due to a change in acceleration or an impact that occurs when the protection member (a cover member) moves.

SUMMARY OF THE INVENTION

The present disclosure provides a configuration in which a foreign object is less likely to drop onto a detection surface of a sensor when a cover member moves.

According to an aspect of the present disclosure, an image forming apparatus includes an image forming unit configured to form a toner image, a rotational member onto which the toner image formed by the image forming unit is to be transferred, a sensor disposed below the rotational member and facing a surface of the rotational member, the sensor being capable of detecting the toner image on the rotational member, a shutter provided, between the sensor and the rotational member, movably in a widthwise direction perpendicular to a movement direction of the rotational member, and configured to cover at least a part of the sensor, the shutter having a detection hole and a cover portion, the detection hole allowing detection of the toner image on the rotational member by exposing a window for detection of the sensor, the cover portion being configured to cover the window, wherein the window and the detection hole face each other when the shutter is at an opened position, and the window and the cover portion face each other when the shutter is at a closed position, and a protruding wall portion provided at the shutter, and provided to protrude upward at least at an upstream edge portion of the detection hole, with respect to a direction in which the shutter moves from the closed position to the opened position.

Further features of the present disclosure will become apparent from the following description of exemplary embodiments with reference to the attached drawings.

DESCRIPTION OF THE EMBODIMENTS

A first exemplary embodiment will be described with reference to FIGS. 1 to 7. First, a schematic configuration of an image forming apparatus of the present exemplary embodiment will be described with reference to FIG. 1.

[Image Forming Apparatus]

An image forming apparatus 100 of the present exemplary embodiment is a tandem full color image forming apparatus of electrophotographic type. The image forming apparatus 100 is a tandem full color printer of electrophotographic type including four image forming units 1Y, 1M, 1C, and 1Bk. The image forming units 1Y, 1M, 1C, and 1Bk have photosensitive drums 2*a*, 2*b*, 2*c*, and 2*d*, respectively, each serving as an image carrier. In the present exemplary embodiment, the image forming units 1Y, 1M, 1C, and 1Bk each have a configuration including a drum and a part around the drum, and this configuration is provided as a cartridge.

The image forming apparatus 100 forms a toner image (an image) on a recording member, according to an image signal from a host apparatus. Examples of the host apparatus include a document reading apparatus (not illustrated) that is connected to an apparatus main body 100A, and a personal computer that is connected to the apparatus main body 100A to communicate with each other. Examples of the recording member include sheet materials, such as a sheet of paper, an envelope, a plastic film, and a cloth. Further, the image forming units 1Y, 1M, 1C, and 1Bk form yellow, magenta, cyan, and black toner images, respectively.

The four image forming units 1Y, 1M, 1C, and 1Bk included in the image forming apparatus 100 have substantially the same configurations except that development colors are different. Therefore, the image forming unit 1Y will be described as a representative. Numerals indicating configurations of the other image forming units are provided with subscripts b, c, and d each indicating a configuration of the corresponding image forming unit, and the description of these configurations will be omitted.

In the image forming unit 1Y, a cylindrical photosensitive member, i.e., the photosensitive drum 2*a*, is disposed as the image carrier. In the photosensitive drum 2*a*, a photoconductive layer having a negative charge polarity is formed on an outer peripheral surface of a cylinder. The photosensitive drum 2*a* is driven to rotate in an arrow direction in FIG. 1. Disposed around the photosensitive drum 2*a* are a charging device (a charging roller) 3*a* serving as a charging unit, a development device 4*a*, a primary transfer roller 5*a*, and a cleaning device 6*a* serving as a cleaning unit. A laser scanner (an exposure device) 7 serving as an exposure unit is disposed below the photosensitive drum 2*a* as illustrated in FIG. 1.

Figure 1:
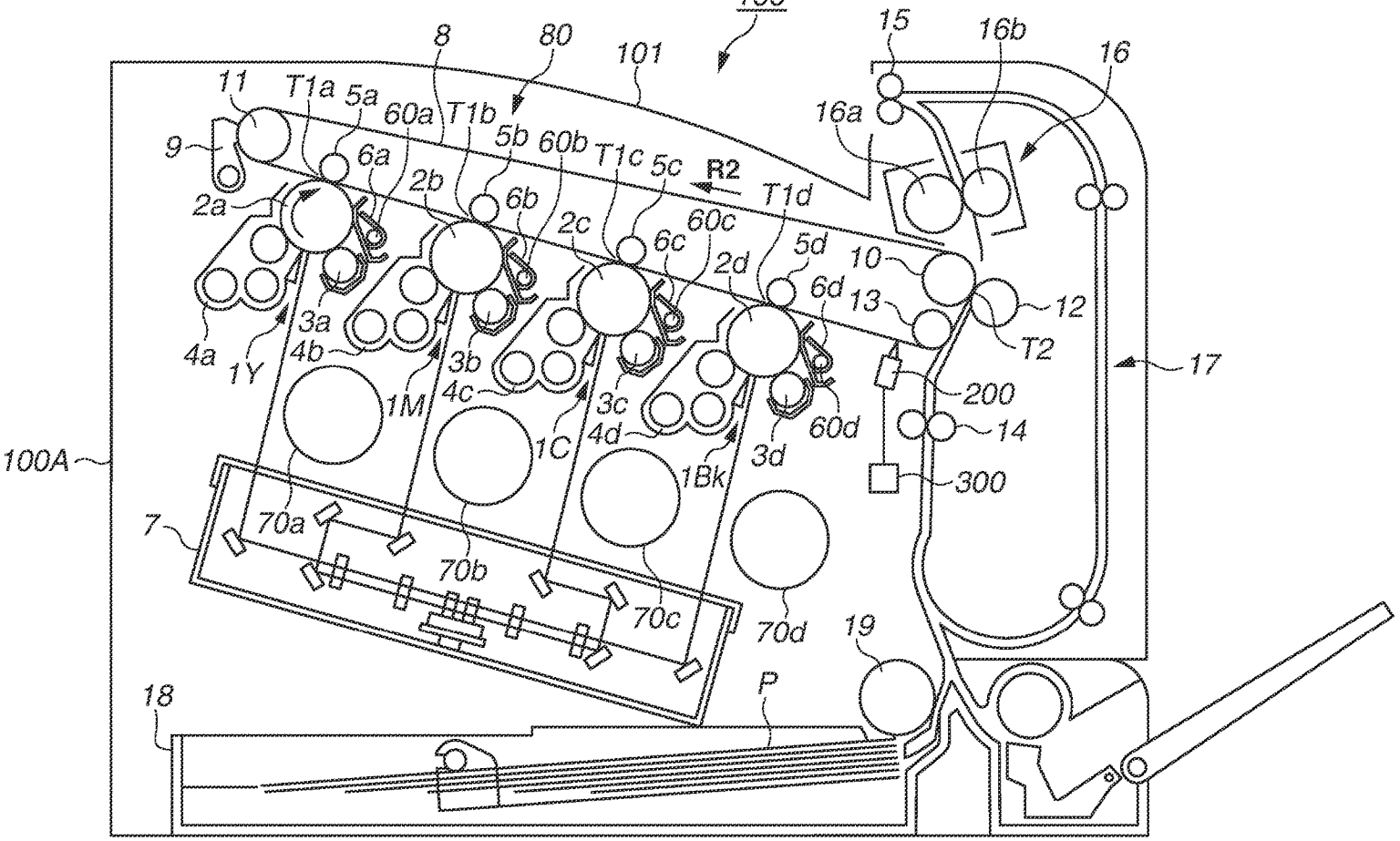
FIG. 1 is a diagram illustrating a schematic configuration of an image forming apparatus according to a first exemplary embodiment.

An intermediate transfer device 80 is disposed above the image forming units 1Y, 1M, 1C, and 1Bk as illustrated in FIG. 1. The intermediate transfer device 80 has an intermediate transfer belt 8, which is an endless belt and serves as a rotatable intermediate transfer member. The intermediate transfer belt 8 is stretched and supported by a tension roller 11, a driving roller 10 also serving as a secondary transfer inner roller, and a tension roller 13. The intermediate transfer belt 8 is driven by the driving roller 10 to rotate an arrow R2 direction. The intermediate transfer belt 8 carries and conveys a toner image primarily transferred to the intermediate transfer belt 8, as will be described below. A secondary transfer outer roller 12 serving as a secondary transfer member is disposed at a position opposite the driving roller 10 with the intermediate transfer belt 8 interposed therebetween. The secondary transfer outer roller 12 is included in a secondary transfer portion T2 for transferring the toner image on the intermediate transfer belt 8 to a recording member. The secondary transfer outer roller 12 has both ends rotatably supported by bearings, and elastically urged toward the intermediate transfer belt 8 by an elastic member via the bearings.

In particular, the intermediate transfer belt 8 of the present exemplary embodiment is stretched by the tension roller 13, at the position before the secondary transfer portion T2. In other words, the tension roller 13 stretches the intermediate transfer belt 8 at a point downstream from a primary transfer portion T1*d* and upstream from the driving roller 10, with respect to a rotation direction of the intermediate transfer belt 8. A fixing device 16 is disposed downstream from the secondary transfer portion T2, in a recording member conveyance direction.

A cassette 18 containing recording members P is disposed at a lower part of the image forming apparatus 100. A separation roller 19 separates and draws the recording members P one by one from the cassette 18, and then sends the recording member P to a registration roller pair 14. The registration roller pair 14 receives the recording member P in a stop state and holds the received recording member P. The registration roller pair 14 then sends the recording member P into the secondary transfer portion T2 at the right timing for the toner image on the intermediate transfer belt 8. In the present exemplary embodiment, the registration roller pair 14 corresponds to a conveyance unit capable of conveying a recording member to the secondary transfer portion T2.

There will be described a process for forming, for example, a full color image of four colors, by the image forming apparatus 100 configured as described above. First, when image forming operation begins, the surface of the photosensitive drum 2*a* rotating is uniformly charged by application of an oscillation voltage to the charging device 3*a*. The oscillation voltage is provided by superimposing an alternating voltage on a direct-current voltage of the negative polarity. Next, the photosensitive drum 2*a* is exposed to laser light which corresponds to an image signal and is generated from the exposure device 7. This forms an electrostatic latent image corresponding to the image signal on the photosensitive drum 2*a*. Here, using a rotary mirror, the exposure device 7 performs scanning on scanning line image data with a laser beam which is ON-OFF modulated. The scanning line image data is obtained by developing a resolution color image of yellow. The exposure device 7 thereby writes an electrostatic latent image on the surface of the charged photosensitive drum 2*a*.

The electrostatic latent image on the photosensitive drum 2*a* is visualized by toner contained in the development device 4*a*, and thereby becomes a visible image. The toner in the development device 4*a* is consumed through image formation, but the development device 4*a* is replenished with toner supplied from a toner bottle 70*a*.

The toner image formed on the photosensitive drum 2*a* is primarily transferred to the intermediate transfer belt 8, at a primary transfer portion T1*a* formed between the photosensitive drum 2*a* and the primary transfer roller 5*a* with the intermediate transfer belt 8 interposed therebetween. In this process, a primary transfer bias (a direct-current voltage of the positive polarity) is applied to the primary transfer roller 5*a*. The cleaning device 6*a* removes the toner (transfer residual toner) remaining on the surface of the photosensitive drum 2*a* after the primary transfer. A toner conveying screw 60*a* conveys the removed toner, and then this toner is conveyed to a toner discharge port (not illustrated) to be discharged from the toner discharge port.

Such operation is performed sequentially in the image forming units 1Y, 1M, 1C, and 1Bk of yellow, magenta, cyan, and black, so that the four-color toner images are superimposed on top of each other on the intermediate transfer belt 8. Afterward, the recording member P contained in the cassette 18 is conveyed to the secondary transfer portion T2, in the right timing for the formation of the toner images. Subsequently, at the secondary transfer portion T2, a predetermined pressing force and a secondary transfer bias (a direct-current voltage of the positive polarity) are applied, so that a transfer field of the toner images is formed between the recording member P and the driving roller 10 connected to a ground potential. The four-color toner images on the intermediate transfer belt 8 are secondarily transferred onto the recording member P, in a collective manner. An intermediate transfer belt cleaner 9 cleans the toner that is not fully transferred at the secondary transfer portion T2 and remains on the intermediate transfer belt 8.

Next, the recording member P is conveyed to the fixing device 16. The fixing device 16 includes a fixing roller 16*a* provided with a heater, and a pressing roller 16*b*. The fixing roller 16*a* and the pressing roller 16*b* form a fixing nip portion. The recording member P onto which the toner images are transferred passes through this fixing nip portion of the fixing device 16, so that the recording member P is heated and pressed. Subsequently, the toners on the recording member P are mixed by melting, and fixed on the recording member as a full color image. The recording member P is then discharged to a discharge tray 101 by a discharge roller 15. This ends a series of image forming processes.

Assume that the image formation is performed on each of two sides of the recording member. In this case, after the toner images are fixed on one side of the recording member, the recording member is conveyed to a two-sided conveyance path 17, and then conveyed again to the secondary transfer portion T2. As a result, the image formation is performed on the back side. The driving roller 10 and the tension roller 11 are not limited to the above-described arrangement, and these positions can be reversed.

[Sensor Unit]

Figure 2:
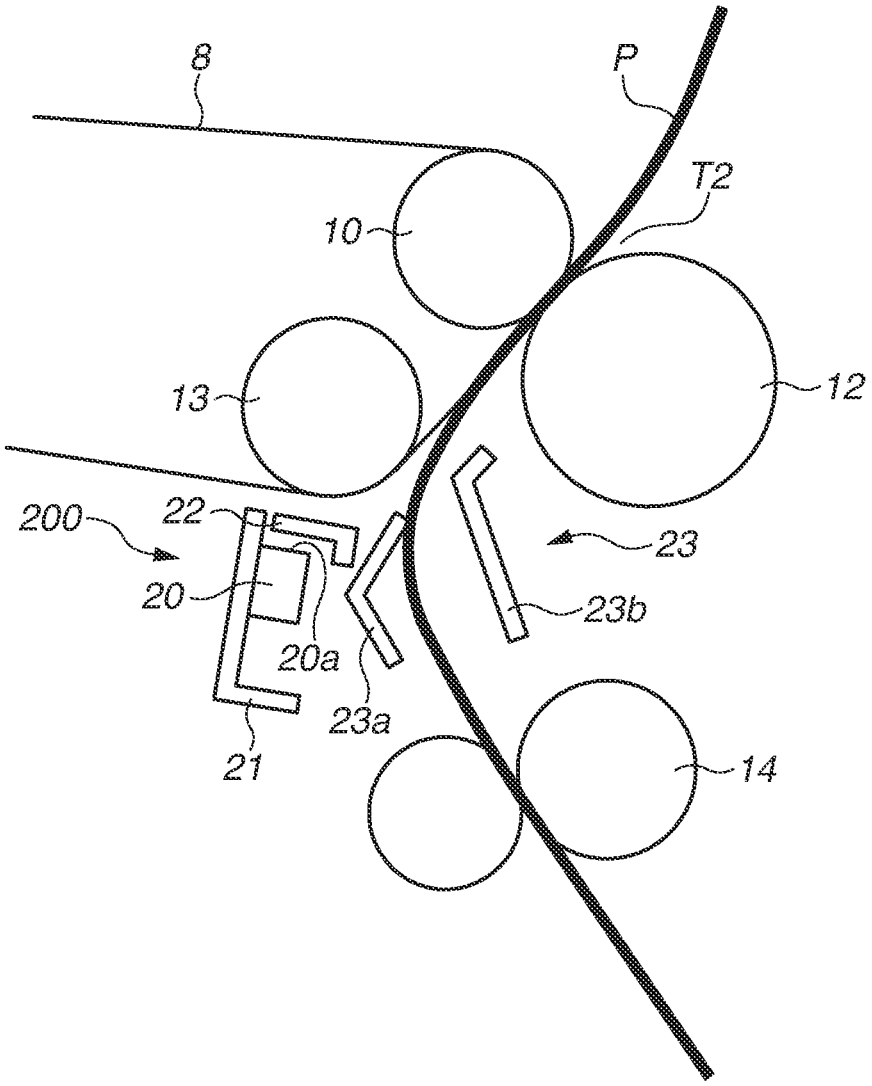
FIG. 2 is a diagram illustrating a configuration including a secondary transfer portion and a part around the secondary transfer portion according to the first exemplary embodiment.

A sensor unit 200 is disposed at a position facing the surface of the intermediate transfer belt 8, between the image forming unit 1Bk and the secondary transfer portion T2. As illustrated in FIG. 2, the sensor unit 200 has a sensor 20, a sensor holding member 21, and a protection member 22. The sensor 20 is capable of detecting a toner image on the intermediate transfer belt 8. The protection member 22 serves as the cover member. The sensor unit 200 is disposed downstream from the primary transfer portion T1*d* and upstream from the secondary transfer portion T2, with respect to the rotation direction of the intermediate transfer belt 8.

The sensor 20 is an optical sensor, and has a light source, a photodetector, and a cover. The light source is, for example, a light emitting diode (LED) light source. The photodetector is, for example, a photodiode. Light is emitted from the light source, and then reflected by the intermediate transfer belt 8. The photodetector then receives the reflected light. The surface of the sensor 20 is covered with a transparent cover. The transparent cover forms a detection surface 20*a* of the sensor 20. The transparent cover is formed of a transparent member (e.g., an acrylic plate) serving as a lens for condensing light. The light source and the photodetector are disposed on the inner side of the transparent cover. The intermediate transfer belt 8 is irradiated with the light emitted from the light source via the transparent cover, and then the light reflected by the intermediate transfer belt 8 is received by the photodetector via the transparent cover. This transparent cover is disposed to be substantially parallel with the surface of the intermediate transfer belt 8, in a state that the sensor unit 200 is installed on the image forming apparatus 100.

In the present exemplary embodiment, the three sensors 20 are held by the sensor holding member 21 in the sensor unit 200, in such a manner that the three sensors 20 are disposed substantially at a regular spacing in a direction (a widthwise direction) perpendicular to the rotation direction of the intermediate transfer belt 8. Further, as will be described below, the sensor unit 200 includes the protection member 22 for protecting the detection surface 20*a* of the sensor 20. A configuration of the protection member 22 will be described below in detail.

[Image Correction]

Each of the sensors 20 detects a toner image for control of each color formed on the intermediate transfer belt 8. A control unit 300 of the image forming apparatus 100 performs image correction, such as color misalignment correction of each color and density correction, as will be described below.

The control unit 300 is provided with a central processing unit (CPU) and a memory. In the memory, a read only memory (ROM) is provided. The ROM stores a program corresponding to a control procedure. The CPU controls each unit while reading out the program stored in the ROM. A random access memory (RAM) that stores data for work and input data is also provided in the memory. The CPU performs control by referring to the data stored in the RAM, based on the above-described program.

When performing the image correction, the control unit 300 forms the toner image for control of each color on the intermediate transfer belt 8, at predetermined timing. The sensor 20 then detects the toner image for control of each color. Specifically, first, the exposure device 7 forms an electrostatic latent image corresponding to the toner image for control of each color, on the surface of each of the photosensitive drums 2*a* to 2*d*. The formed electrostatic latent image is visualized by each of the development devices 4*a* to 4*d*, as the toner image for control. The toner images on the respective photosensitive drums 2*a* to 2*d* are primarily transferred to the intermediate transfer belt 8 sequentially, by the primary transfer rollers 5*a* to 5*d*. The sensor 20 detects the toner images for control primarily transferred to the intermediate transfer belt 8. The control unit 300 processes information representing the detected toner images for control, thereby calculating a color misalignment correction amount and a density correction amount. The control unit 300 then feeds the calculated amounts back to an output image.

In other words, with respect to the toner image for control of yellow, which is a reference color, formed in the image forming unit 1Y at the most upstream position, the control unit 300 calculates a misalignment amount of each of the toner images for control of the other colors. From the calculated amount of color misalignment, the control unit 300 performs correction for aligning the image of each color by, for example, adjusting an exposure start position of the exposure device 7 in each of the image forming units 1Y, 1M, 1C, and 1Bk. Among the three sensors 20, for example, the sensor 20 in the middle serves as a density detecting sensor for the toner image. The control unit 300 calculates a density correction amount of each color from a detection result of this sensor 20. The control unit 300 performs the density correction for the toner image of each color by, for example, adjusting an amount of exposure of the exposure device 7, or a bias to be applied to each of the development devices 4*a* to 4*d* in the development.

[Position of Sensor Unit]

Next, the position of the sensor unit 200 will be described with reference to FIGS. 1 and 2. The image forming apparatus 100 of the present exemplary embodiment has a configuration of so-called vertical conveyance type, in which the recording member P is conveyed upward from the cassette 18 provided at the lower part as illustrated in FIG. 1. The secondary transfer portion T2 is located above the registration roller pair 14. The sensor unit 200 is disposed at a position adjacent to a conveyance path 23 in a horizontal direction. The conveyance path 23 is provided to convey the recording member P from the registration roller pair 14 to the secondary transfer portion T2. In other words, the sensor unit 200 is disposed at a position overlapping the conveyance path 23, when horizontally viewed.

As illustrated in FIG. 2, the conveyance path 23 is disposed between the registration roller pair 14 and the secondary transfer portion T2. The conveyance path 23 is configured of a pre-secondary-transfer inner guide 23*a* and a pre-secondary-transfer outer guide 23*b*. The recording member P sent by the registration roller pair 14 is guided to the secondary transfer portion T2, by passing between the pre-secondary-transfer inner guide 23*a* and the pre-secondary-transfer outer guide 23*b*.

The sensor 20 held by the sensor holding member 21 is disposed below the tension roller 13 and adjacent to the pre-secondary-transfer inner guide 23*a*. In other words, the position of the sensor unit 200 is as close as possible to the tension roller 13. Assume that the surface of the intermediate transfer belt 8 is to be detected by the sensor unit 200, at a position away from a stretched-by-roller part of the intermediate transfer belt 8. In this case, detection accuracy may decrease due to fluttering of the intermediate transfer belt 8. For this reason, in the present exemplary embodiment, the sensor unit 200 is disposed to face a part, which is stretched by the tension roller 13, of the intermediate transfer belt 8, or to face a part being as close as possible to this part. This suppresses the decrease in the detection accuracy due to the fluttering of the intermediate transfer belt 8. This also contributes to downsizing of the image forming apparatus 100.

[Scattering of Foreign Objects]

Figure 3:
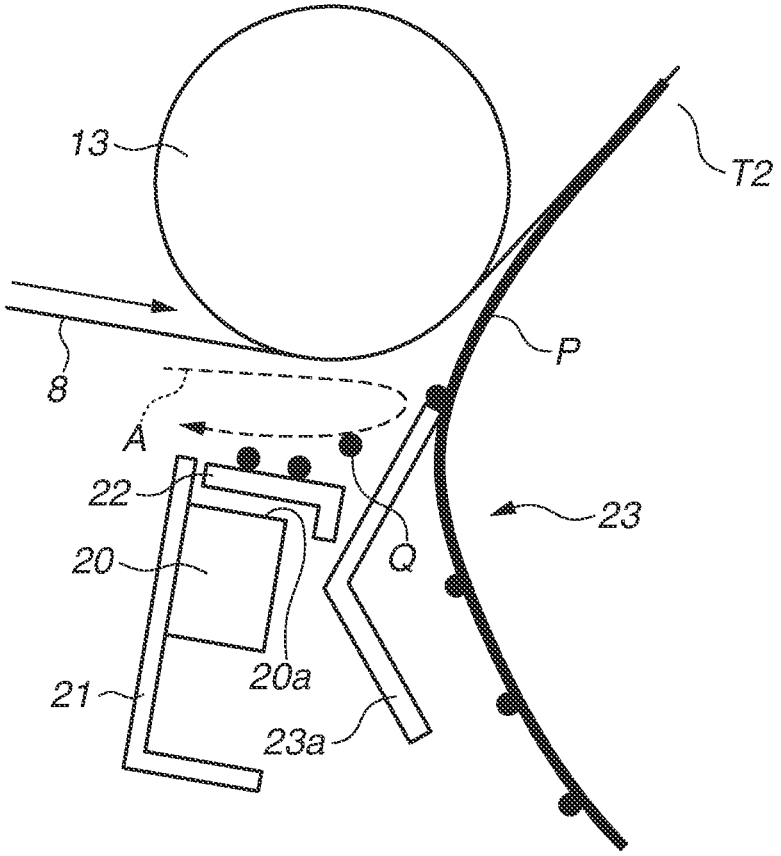
FIG. 3 is a diagram illustrating details of a sensor and a part around the sensor according to the first exemplary embodiment.

Here, a mechanism of occurrence and scattering of foreign objects, such as paper dust and toner, will be described with reference to FIG. 3. For example, due to rubbing between an upper end portion of the pre-secondary-transfer inner guide 23*a* and the recording member P, foreign objects Q such as paper dust and toner adhering to the surface of the recording member P are separated and scattered in space. When the recording member P arrives at the secondary transfer portion T2, the recording member P and the conveyance path 23 including the pre-secondary-transfer inner guide 23*a* block the conveyance path 23 side of the sensor unit 200. At this moment, an air current A caused by the rotation of the intermediate transfer belt 8 flows rightward in FIG. 3, and then hits the recording member P and the conveyance path 23, as indicated by a broken-line arrow. The air current A then flows to return from the recording member P and the conveyance path 23, to the sensor unit 200.

Therefore, the foreign objects Q such as paper dust and toner during the conveyance of the recording member P flow toward the sensor unit 200, and then easily adhere to the sensor unit 200. In particular, in a case in which the distance from the sensor unit 200 to the secondary transfer portion T2 is reduced as described above, the distance between the sensor unit 200 and the recording member P conveyed in the conveyance path 23 as well as the conveyance path 23 is also reduced. For this reason, the foreign objects Q carried by the air current A easily adhere to the sensor unit 200, specifically, to the top surface of the protection member 22 of the sensor unit 200.

[Protection Member]

The protection member 22 serving as the cover member will be described in detail, with reference to FIGS. 4 to 6. The protection member 22 is disposed between the sensor 20 and the intermediate transfer belt 8. In a closed state of the protection member 22 to be described below, the protection member 22 reduces adherence of toner, which is scattered from the intermediate transfer belt 8, and foreign objects, which are scattered from the conveyance path 23 side, to the sensor 20 by the air current A.

Between the sensor 20 and the intermediate transfer belt 8, the protection member 22 is disposed movably between a first position and a second position. The protection member 22 protects the detection surface 20*a* formed of the transparent cover of the sensor 20. The detection surface 20*a* of the sensor 20 faces upward. Therefore, the protection member 22 is disposed above the sensor 20. The sensor unit 200 is disposed such that a lengthwise direction thereof is parallel to the widthwise direction, which is perpendicular to the rotation direction, of the intermediate transfer belt 8. The protection member 22 is capable of moving in a direction (an arrow direction in FIG. 4) along the lengthwise direction of the sensor unit 200.

Figure 4:
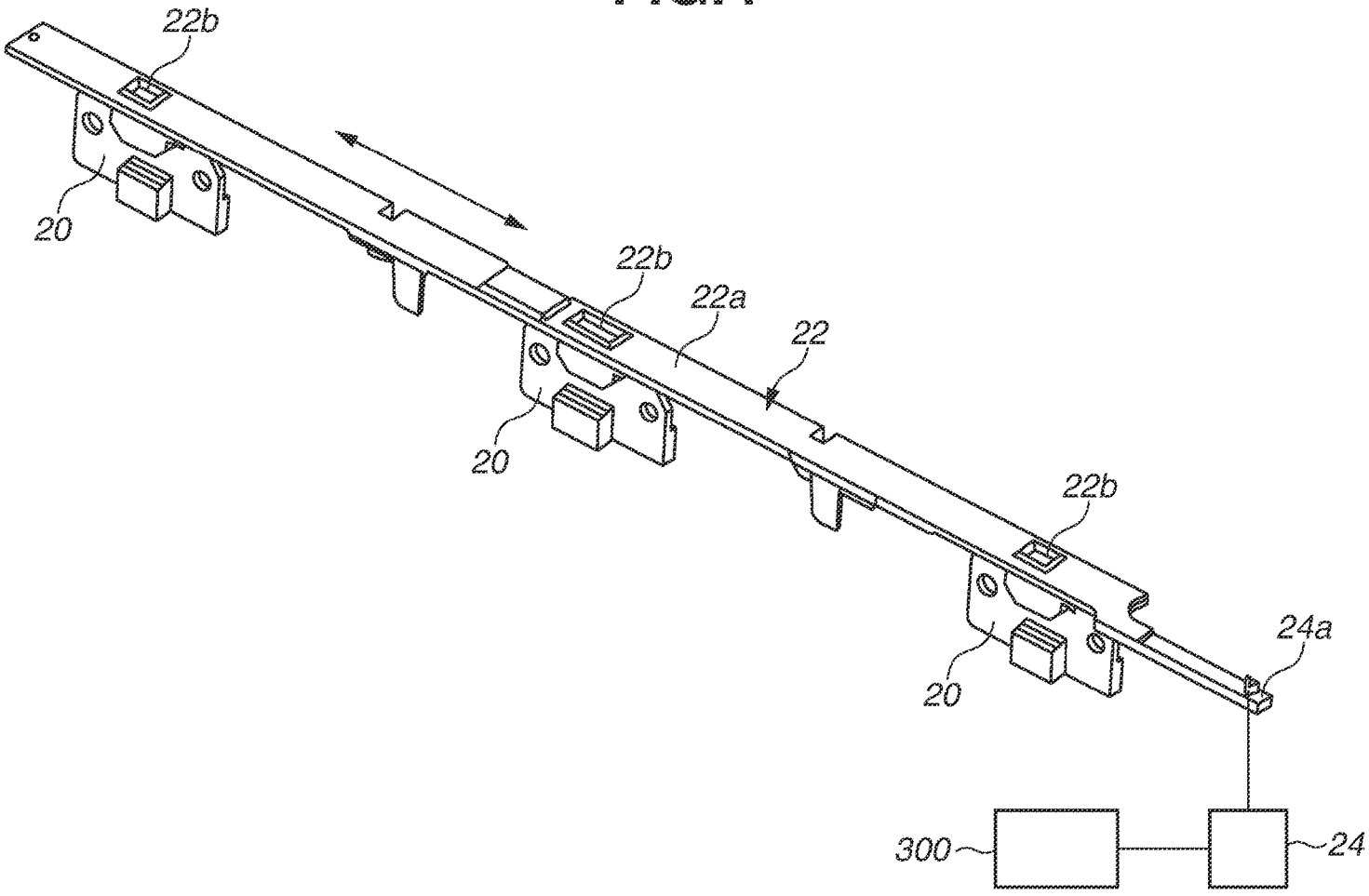
FIG. 4 is a perspective diagram of a protection member according to the first exemplary embodiment.

Further, three detection holes 22*b* corresponding to the three sensors 20 are formed in the protection member 22, as illustrated in FIG. 4. In a case where the protection member 22 is located at the first position, the detection holes 22*b* expose the detection surfaces 20*a* of the sensors 20. The detection holes 22*b* are formed in such a manner that the toner image on the intermediate transfer belt 8 (on the intermediate transfer member) can be detected by the sensor 20 via the detection holes 22*b*. Further, in a case where the protection member 22 is located at the second position, the protection member 22 covers the detection surface 20*a* of the sensor 20, with a covering portion 22*a*, which is a part where the detection hole 22*b* is not formed. In the present exemplary embodiment, the two sensors 20 at both ends in the widthwise direction are sensors for detecting only an amount of color misalignment, and the sensor 20 in the middle is a sensor for detecting both of an amount of color misalignment and a density shift amount. For this reason, the detection holes 22*b* each have an area appropriate to the corresponding sensor 20. However, the number and the functions of the sensors are not limited to this configuration.

Figure 5A:
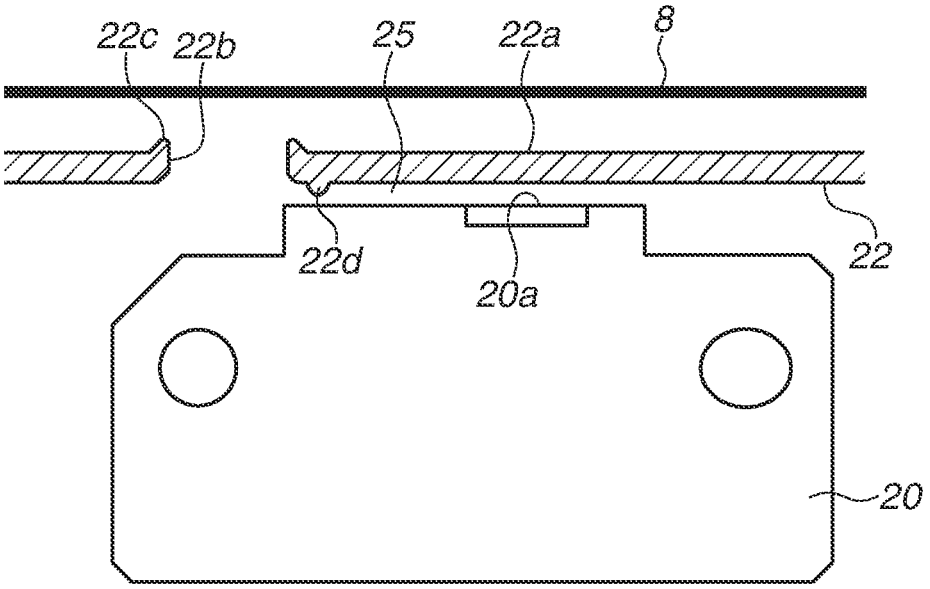
FIGS. 5A and 5B are diagrams illustrating a closed state and an opened state, respectively, of the protection member according to the first exemplary embodiment.
Figure 5B:
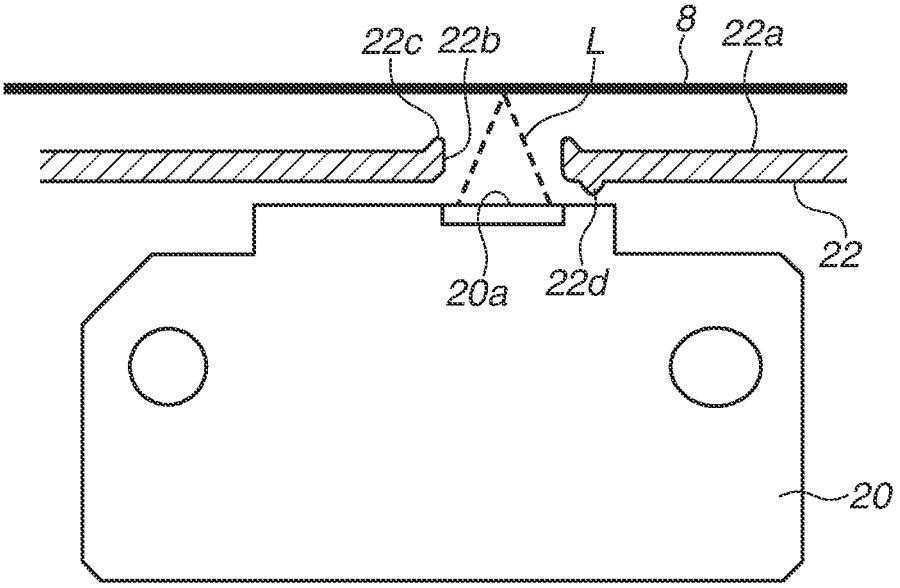

The protection member 22 is movable in the above-described direction, by a movement mechanism 24 coupled to a coupling portion 24*a*. In other words, the movement mechanism 24 can move the protection member 22 between the closed state (the second position) and the opened state (the first position). In the closed state (the second position), the detection surface 20*a* is covered with the covering portion 22*a*, as illustrated in FIG. 5A. In the opened state (the first position), the detection surface 20*a* is exposed via the detection hole 22*b*, as illustrated in FIG. 5B. The movement mechanism 24 is configured of, for example, a solenoid and a link. The link is coupled to the coupling portion 24*a* of the protection member 22. Therefore, the control unit 300 drives the solenoid, thereby moving the protection member 22 in the lengthwise direction of the sensor unit 200 via the link.

For example, in a case where no detection is to be performed by the sensor 20, the control unit 300 moves the protection member 22 to the closed state, namely, the second position, illustrated FIG. 5A, by turning off (not energizing) the solenoid. In other words, the control unit 300 prevents the foreign objects Q from directly arriving at the detection surface 20*a*, by retracting the detection hole 22*b* from a position above the detection surface 20*a* of the sensor 20, and thereby covering the detection surface 20*a* with the covering portion 22*a*.

On the other hand, in a case where detection is to be performed by the sensor 20, the control unit 300 moves the protection member 22 to the opened state, namely, the first position, illustrated in FIG. 5B, by turning on (energizing) the solenoid. In other words, the control unit 300 allows reading of the toner image for control on the intermediate transfer belt 8, by moving the detection hole 22*b* to the position above the detection surface 20*a* of the sensor 20, so as not to block a light path L of the sensor 20.

The relationship between on/off of the solenoid and the movement positions of the protection member 22 may be the reverse of the above-described example. The driving source for moving the protection member 22 may be a source other than the solenoid, e.g., a motor. The mechanism for coupling the protection member 22 and the driving source may be a mechanism other than the link mechanism, e.g., a cam mechanism.

Further, in the present exemplary embodiment, as illustrated in FIG. 5A, a shielding portion 22*d* is provided between the detection hole 22*b* and the sensor 20, in the state (the closed state) that the protection member 22 is located at the second position. The shielding portion 22*d* is provided in a space 25 between the protection member 22 and the sensor 20. The shielding portion 22*d* shields at least a part of the space 25 between the detection hole 22*b* and the detection surface 20*a* of the sensor 20, with respect to a movement direction of the protection member 22. In the present exemplary embodiment, the shielding portion 22*d* is a protruding portion formed to protrude from the protection member 22 into the space 25. Thus providing the shielding portion 22*d* can make it difficult for the foreign objects entering the sensor unit 200 from the detection hole 22*b* to enter a space on the detection surface 20*a* side of the sensor 20. This can make it more difficult for the foreign objects to adhere to the detection surface 20*a*.

[Protruding Wall Portion]

Figure 6:
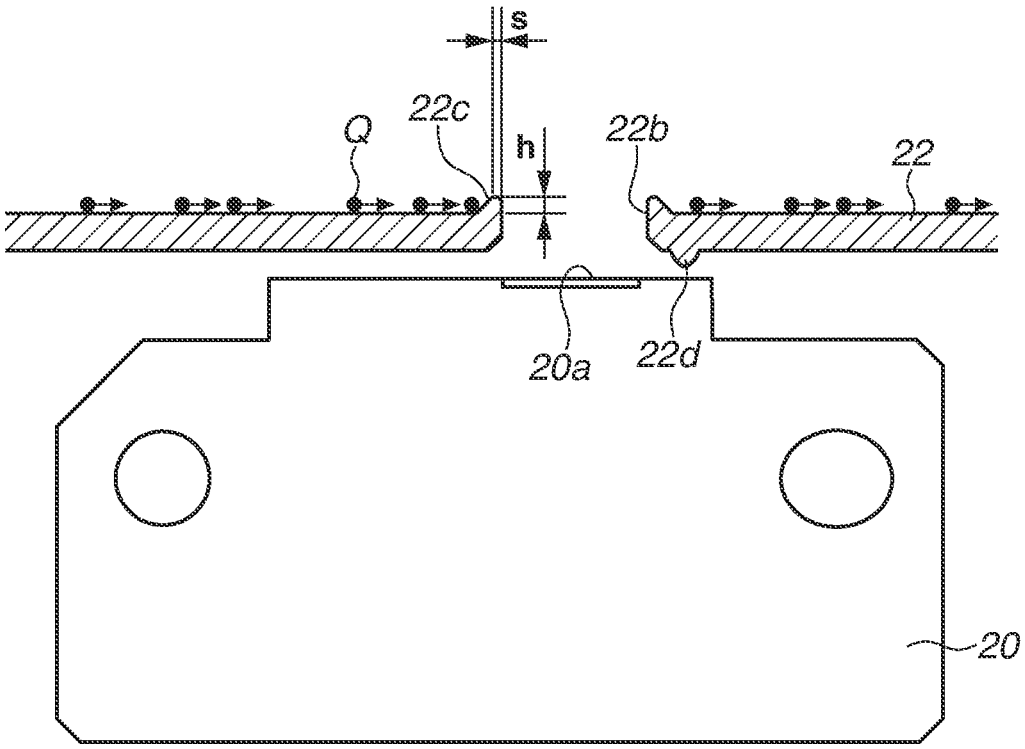
FIG. 6 is a diagram illustrating details of a sensor unit according to the first exemplary embodiment.

Here, when the protection member 22 moves from the closed state to the opened state, the foreign objects Q accumulated on the protection member 22 tend to move in an arrow direction illustrated in FIG. 6, due to inertia. The inertia is caused by deceleration and an impact for stoppage of the protection member 22 at the position in the opened state. When the protection member 22 moves from the opened state to the closed state, the foreign objects Q accumulated on the protection member 22 tend to move in the same direction as the above-mentioned arrow direction, due to inertia caused by acceleration of the protection member 22. In either case, the foreign objects Q may drop onto the detection surface 20*a* of the sensor 20 from the detection hole 22*b*, because of the movement of the foreign objects Q due to the inertia.

Therefore, in the present exemplary embodiment, as illustrated in FIG. 6, a protruding wall portion 22*c* is provided along the entire perimeter of the edge of the detection hole 22*b*, so as to protrude beyond the top surface of the protection member 22. The protruding wall portion 22*c* is formed integrally with the protection member 22 made of resin. The foreign objects Q on the protection member 22 may drop from the detection hole 22*b* by moving in the arrow directions illustrated in FIG. 6. Therefore, the protruding wall portion 22*c* may not be provided along the entire perimeter of the detection hole 22*b*. In other words, the protruding wall portion 22*c* may be provided at least at an edge on a side upstream from the detection hole 22*b*, with respect to the direction in which the protection member 22 moves from the second position to the first position.

In a case where the shape of the detection hole 22*b* is a rectangle as illustrated in FIG. 4, the protruding wall portion 22*c* may be provided at least at an upstream edge. If the shape of the detection hole 22*b* is, for example, a circle, the protruding wall portion 22*c* may be provided at an upstream semicircular edge. In other words, it is desirable that the protruding wall portion 22*c* cover the entire upstream edge of the detection hole 22*b*, in a case where the detection hole 22*b* is viewed from the upstream side with respect to the movement direction from the second position to the first position. The foreign objects Q, which are on the protection member 22 and move in the arrow directions in FIG. 6, do not easily enter the detection hole 22*b*, by hitting the protruding wall portion 22*c*.

However, as in the present exemplary embodiment, it is more preferable to provide the protruding wall portion 22*c* along the entire perimeter of the detection hole 22*b*. This is because the foreign objects Q accumulated around the detection hole 22*b* may enter the detection hole 22*b* from a side other than the upstream side of the detection hole 22*b*, due to three-dimensional vibrations caused by an impact when the protection member 22 moves. Therefore, providing a configuration as in the present exemplary embodiment can effectively prevent the foreign objects Q from entering the detection hole 22*b* and then dropping onto the detection surface 20*a* during the movement of the protection member 22.

In addition, the protruding wall portion 22*c* has a height h (a protrusion amount) from the top surface of the protection member 22, and the height h is preferably 0.3 mm or more. The reason for this is as follows. First, in general, the particle diameters of paper dust widely ranges from a few micrometers to a few millimeters. However, only paper dust of a certain mass or less is accumulated on the protection member 22, because the paper dust produced at the pre-secondary-transfer inner guide 23*a* moves on the air current A, as described above. The paper dust is usually formed of particles of a particle diameter of 0.3 mm or less. The paper dust may include a small amount of flat pieces of paper each having a large area of 0.5 mm or more. In general, such flat pieces of paper each have a thickness of 0.3 mm or less. The paper dust including flat pieces of paper each having a thickness more than this size drops before arriving at the protection member 22. In this way, the size of the paper dust expected to settle on the protection member 22 is limited.

In addition, a toner particle diameter is usually 5 μm to 10 μm. Therefore, the size of the foreign objects Q such as toner and paper dust accumulated on the protection member 22 is 0.3 mm or less in diameter and thickness, in most cases. Therefore, to effectively control the dropping of the foreign objects Q from the detection hole 22*b* accompanying the movement of the protection member 22, the height h of the protruding wall portion 22*c* may be 0.3 mm or more.

In addition, even in a case where the protruding wall portion 22*c* is provided, if a width s of the top surface of the protruding wall portion 22*c* is large, the foreign objects Q of an amount proportional to the size of the width s may be accumulated on this top surface, and drop from the detection hole 22*b*. Therefore, this width s of the top surface is preferably as small as possible, and is preferably, for example, 0.3 mm or less. Here, the protruding wall portion 22*c* is formed integrally with the protection member 22 made of a resin material. Therefore, in a case where the protruding wall portion 22*c* has the same width as the span in the height direction, it is difficult to ensure a wall thickness for keeping the rigidity and moldability of the protruding wall portion 22*c*, if this width is reduced.

Therefore, in the present exemplary embodiment, the protruding wall portion 22*c* is formed to be higher as being closer to the detection hole 22*b*. Specifically, the protruding wall portion 22*c* is formed to have a smaller width as being closer to the top surface, by inclining an outer surface of the protruding wall portion 22*c*. The outer surface is located outside the detection hole 22*b*. This ensures a wall thickness for keeping the rigidity and the moldability of the protruding wall portion 22*c*. Besides, accumulation of the foreign objects Q on the top surface is made less likely to occur, by making the width s of the top surface small, i.e., making the area of the top surface small.

According to the present exemplary embodiment, it is possible to make it difficult for the foreign objects Q drop onto the detection surface 20*a* of the sensor 20, during the movement of the protection member 22. In other words, the protruding wall portion 22*c* forming the edge of the detection hole 22*b* is formed on the top surface of the protection member 22, integrally with the protection member 22, thereby preventing the foreign objects Q from moving toward the detection hole 22*b* due to the inertia. For this reason, it is possible to suppress free dropping of the foreign objects Q from the detection hole 22*b* and adherence of the foreign objects Q to the detection surface 20*a* of the sensor 20.

Figure 7:
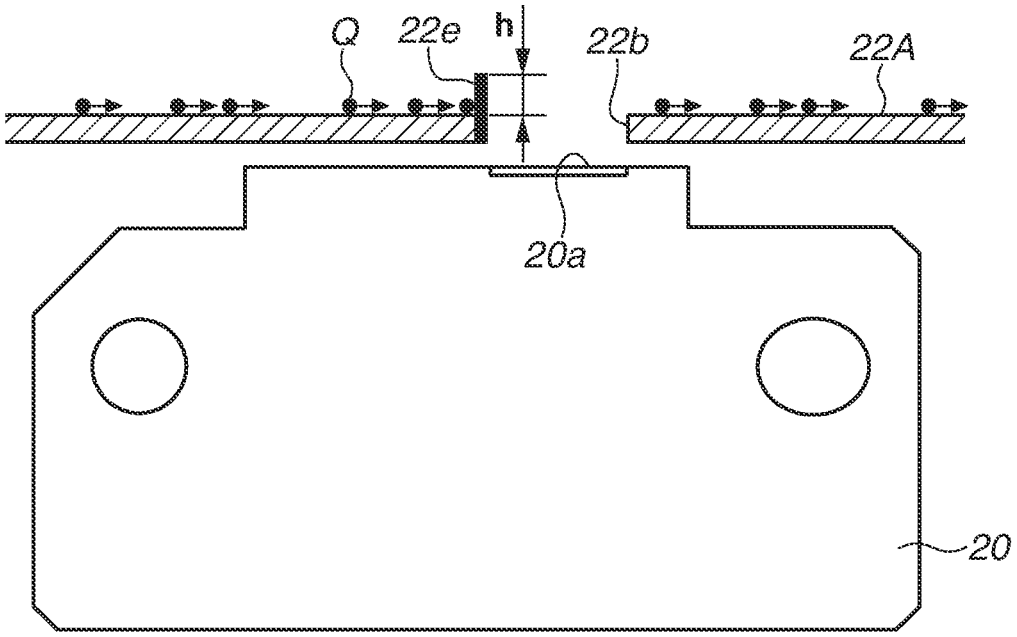
FIG. 7 is a diagram illustrating details of a sensor unit according to a second exemplary embodiment.

A second exemplary embodiment will be described with reference to FIG. 7. In the above-described first exemplary embodiment, the protruding wall portion 22*c* is formed integrally with the protection member 22. In contrast, in the second exemplary embodiment, a protruding wall portion 22*e* is a sheet member. Other configurations and actions are similar to those of the above-described first exemplary embodiment. Therefore, the same configurations are provided with the same numerals, and the description thereof is omitted or simplified. A part different from the first exemplary embodiment will be mainly described below.

The protruding wall portion 22*e* is a sheet member provided at an edge of the detection hole 22*b*. This sheet member is a member having rigidity to some extent, such as a plastic sheet. This sheet member has a thickness of preferably, for example, 0.3 mm or less, and more preferably, 0.1 mm or less. The protruding wall portion 22*e* is configured by fixing such a sheet member to the edge of the detection hole 22*b* with an adhesive, in such a manner that the protruding wall portion 22*e* protrudes from the top surface of a protection member 22A by, for example, 0.3 mm or more.

Further, in the present exemplary embodiment, the protruding wall portion 22*e* is provided at the edge on an upstream side of the detection hole 22*b*, with respect to a direction in which the protection member 22A moves from the second position to the first position. However, the protruding wall portion 22*e* may be provided along the entire perimeter of the edge of the detection hole 22*b*, as in the first exemplary embodiment. Furthermore, although the protection member 22A does not have the shielding portion 22*d*, the shielding portion 22*d* may be provided as in the first exemplary embodiment.

As described above, in the present exemplary embodiment, the protruding wall portion 22*e* is the sheet member. It is therefore possible to make it more difficult for the foreign objects Q to be accumulated on the top surface of the protruding wall portion 22*e*. The protruding wall portion 22*e* is separate from the protection member 22A, and fixed to the edge of the detection hole 22*b*. Therefore, a wall thickness for assuring the rigidity and the moldability of the protruding wall portion 22*e* may not be ensured. Hence, the thickness of the protruding wall portion 22*e* can be further reduced, and the accumulation of the foreign objects Q on the top surface can be made more difficult. As a result, the dropping of the foreign objects Q onto the detection surface 20*a* of the sensor 20 during the movement of the protection member 22A can be made more difficult.

Other Exemplary Embodiments

The intermediate transfer member may be a member other than an endless belt, e.g., a drum. The sensor for detecting the toner image on the intermediate transfer member may have a configuration other than the above-described optical sensor, e.g., a configuration for detecting a toner image with an image sensor. In short, the configuration for detection with the sensor is not limited in particular, and any configuration may be adopted if the configuration is to detect a toner image via a detection surface.

In the above-described exemplary embodiments, the tension roller 13 is provided upstream from the driving roller 10, but the tension roller 13 may be omitted. In this case, for example, the sensor unit 200 is provided at a position as close as possible to the driving roller 10.

Further, in the above-described exemplary embodiments, there is described the configuration of the vertical conveyance type for conveying the recording member in the upward direction toward the secondary transfer portion T2. However, the present disclosure is also applicable to a configuration of a horizontal conveyance type for conveying a recording member substantially in a horizontal direction toward the secondary transfer portion T2. In other words, the conveyance direction of the recording member is not limited in particular. However, the present disclosure is preferably applicable to a configuration in which the sensor unit is disposed in such a manner that the top surface of the protection member and the detection surface face upward, rather than facing horizontally. In such a configuration, the foreign objects are readily accumulated on the top surface of the protection member and thus, the effect of reducing the adherence of the foreign objects is more remarkably obtained.

According to the present invention, it is possible to provide a configuration in which foreign objects do not easily drop on a detection surface of a sensor during movement of a cover member.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-008954, filed Jan. 20, 2017, which is hereby incorporated by reference herein in its entirety.

What is claimed is:

1. An image forming apparatus comprising:

an image bearing member;

a rotatable intermediate transfer belt configured to receive a toner image from the image bearing member;

a sensor disposed below the intermediate transfer belt and facing a surface of the intermediate transfer belt, the sensor being capable of detecting the toner image on the intermediate transfer belt; and a shutter provided, between the sensor and the intermediate transfer belt, movably in a widthwise direction perpendicular to a movement direction of the intermediate transfer belt, and configured to open and close the sensor, the shutter having an opening configured to open the sensor, wherein among edge portions defining a perimeter of the opening of the shutter, an upstream edge portion provided upstream from the opening in an opening direction of the shutter includes a protruding wall portion protruding upward beyond a top surface of the shutter.

2. The image forming apparatus according to claim 1, wherein the protruding wall portion has a width equal to or more than a width of the opening.

3. The image forming apparatus according to claim 1, wherein the protruding wall portion has a height of 0.3 mm or more, from the top surface of the shutter.

4. The image forming apparatus according to claim 1, wherein the protruding wall portion is formed along an entire perimeter of the opening.

5. The image forming apparatus according to claim 1, wherein the protruding wall portion is integrally formed with the shutter.

6. The image forming apparatus according to claim 1, wherein the protruding wall portion is formed such that a height thereof increases with a distance getting close to the opening.

7. The image forming apparatus according to claim 1, wherein the protrusion wall portion is a sheet member provided at the shutter.

8. The image forming apparatus according to claim 1, wherein a width in a thickness direction on the top surface of the protrusion wall portion is 0.3 mm or less, with respect to a movement direction of the shutter.

9. The image forming apparatus according to claim 1, further comprises: a secondary transfer member and a conveyance path, the secondary transfer member forming a secondary transfer portion for transferring the toner image from the intermediate transfer belt onto a recording member by abutting the intermediate transfer belt, the conveyance path conveying the recording member to the secondary transfer portion, and wherein the sensor is provided downstream from the primary transfer portion and upstream from the secondary transfer portion, with respect to a rotation direction of the intermediate transfer-belt.

10. The image forming apparatus according to claim 1, further comprising:

a driving unit configured to drive the shutter;

an urging member configured to urge the shutter in a closing direction, wherein the driving unit is a solenoid for moving the shutter in an opening direction by being energized.

11. An image forming apparatus comprising:

an image bearing member;

a rotatable intermediate transfer belt configured to receive a toner image from the image bearing member;

a first sensor disposed below the intermediate transfer belt and facing a surface of the intermediate transfer belt, the first sensor being capable of detecting the toner image on the intermediate transfer belt;

a second sensor disposed below the intermediate transfer belt and facing the surface of the intermediate transfer belt, the second sensor being capable of detecting the toner image on the intermediate transfer belt; and a shutter provided, between each of the sensors and the intermediate transfer belt, movably in a widthwise direction perpendicular to a movement direction of the intermediate transfer belt, and configured to open and close the each of the sensors, the shutter having a first opening configured to open the first sensor and a second opening configured to open the second sensor, wherein among first edge portions defining a perimeter of the first opening of the shutter, a first upstream edge portion provided upstream from the first opening in an opening direction of the shutter includes a first protruding wall portion protruding upward beyond a top surface of the shutter, and among second edge portions defining a perimeter of the second opening of the shutter, a second upstream edge portion provided upstream from the second opening in the opening direction of the shutter includes a second protruding wall portion protruding upward beyond the top surface of the shutter.

12. The image forming apparatus according to claim 11, wherein the first protruding wall portion has a width equal to or more than a width of the first opening, and the second protruding wall portion has a width equal to or more than a width of the second opening.

13. The image forming apparatus according to claim 11, wherein the first protruding wall portion and the second protruding wall portion each have a height of 0.3 mm or more, from the top surface of the shutter.

14. The image forming apparatus according to claim 11, wherein the first protruding wall portion is formed along an entire perimeter of the first opening, and the second protruding wall portion is formed along an entire perimeter of the second opening.

15. The image forming apparatus according to claim 11, wherein the first protruding wall portion and the second protruding wall portion are integrally formed with the shutter.

16. The image forming apparatus according to claim 11, wherein the first protruding wall portion is formed such that a height thereof increases with a distance getting closer to the first opening, and the second protruding wall portion is formed such that a height thereof increases with a distance getting closer to the second opening.

17. The image forming apparatus according to claim 11, wherein each of the first protrusion wall portion and the second protrusion wall portion is a sheet member provided at an edge of the corresponding detection hole.

18. The image forming apparatus according to claim 11, wherein a width in a thickness direction on the top surface of each of the first protrusion wall portion and the second protrusion wall portion is 0.3 mm or less.

19. The image forming apparatus according to claim 11, further comprises: a secondary transfer member and a conveyance path, the secondary transfer member forming a secondary transfer portion for transferring the toner image from the intermediate transfer belt onto a recording member by abutting the intermediate transfer belt, the conveyance path conveying the recording member to the secondary transfer portion, and wherein the sensor is provided downstream from the primary transfer portion and upstream from the secondary transfer portion, with respect to a rotation direction of the intermediate transfer-belt.

20. The image forming apparatus according to claim 11, further comprising:

a driving unit configured to drive the shutter; and an urging member configured to urge the shutter in a closing direction, wherein the driving unit is a solenoid for moving the shutter in an opening direction by being energized.

* * * * *